United States Patent [19]

Glassman

[11] Patent Number: 4,944,285

[45] Date of Patent: Jul. 31, 1990

[54] EXHAUST HOOD FOR PIZZA OVENS

[76] Inventor: Joseph T. Glassman, 303 W. 38th St., Hays, Kans. 67601

[21] Appl. No.: 428,626

[22] Filed: Oct. 30, 1989

Related U.S. Application Data

[63] Continuation-in-part of Ser. No. 365,765, May 25, 1989, Pat. No. 4,896,657.

[51] Int. Cl.[5] ..... F24C 15/20

[52] U.S. Cl. ..... 126/299D

[58] Field of Search ..... 126/299 R, 299 D

[56] References Cited

U.S. PATENT DOCUMENTS 3,530,784 9/1970 Courchesne ..... 126/299 D
3,978,777 9/1976 Hett ..... 126/299 D
4,541,409 9/1985 Karst et al. ..... 126/299 D
4,556,046 12/1985 Riffel et al. ..... 126/299 D

*Primary Examiner*—Harold Joyce

[57] ABSTRACT

An exhaust hood for a pizza oven which induces exhaust materials into the exhaust stream by creating high velocity flow of outside air in the hood. An intake fan forces outside air into a pair of intake plenums located along opposite sides of the hood. Each intake plenum presents an elongate outlet slot, thus creating two high velocity air streams flowing toward one another in opposite directions. A central exhaust plenum in the hood receives the air and the entrained exhaust materials from the oven. An exhaust fan draws air into the exhaust plenum through inclined grease filters.

3 Claims, 1 Drawing Sheet

EXHAUST HOOD FOR PIZZA OVENS

BACKGROUND AND SUMMARY OF THE INVENTION

This application is a continuation in part of pending application Ser. No. 365,765, filed May 25, 1989 now U.S. Pat. No. 4,896,657 and entitled "Exhaust Hood System and Method for Pizza Ovens".

This invention relates in general to the field of exhaust hoods and more particularly to a method and apparatus for exhausting heat and vapors generated by pizza ovens.

In the pizza industry, the pizza ovens which are used to cook pizzas generate considerable heat, smoke, vapors and grease laden air which must be exhausted from the building. Typically, an exhaust hood of some kind is installed above the pizza oven and equipped with an exhaust fan which operates to exhaust the heat and vapors that enter it. Conventional pizza oven hoods effect a front to back flow of air which is somewhat inefficient because the rising heat and vapor must be abruptly turned through a right angle in the hood. Furthermore, the flow pattern can be disrupted by local areas of turbulence which can reduce the efficiency and effectiveness of the exhaust system.

The volume of air that is exhausted from within the building by the exhaust hood must be made up by other air handling equipment. Thus, in the winter, the furnace must be operated to heat the air which serves as make up air to replace the volume that is exhausted by the pizza oven hood. Conversely, the air which is drawn into the building to replace the air that is exhausted in the summertime must be cooled by the air conditioning system of the building. In both cases, there are added energy demands on the air handling equipment, and these lead to significant additional costs.

Pending application Ser. No. 356,765 discloses a pizza oven hood which successfully deals with these problems by making use of an intake fan and an exhaust fan in combination and balancing the air flow such that the pizza oven is effectively exhausted without undue added demand on the air handling equipment of the building. It has now been discovered that a similar system but with the air flow direction reversed achieves even better results, and such a system is the subject of the present invention.

In accordance with the invention, a specially constructed pizza oven hood has a central exhaust plenum which extends above the pizza oven from front to back. Two intake plenums are provided, one extending from front to back along each side of the hood. Outside air is forced into the intake plenums by one or more intake fans. The incoming air passes through restricted throats in the intake plenums into the main part of the hood.

It is an important feature of the invention that the intake system provides two oppositely flowing air streams which travel at a relatively high velocity from the opposite sides of the hood toward the exhaust plenum at the center. This high velocity air flow creates a suction effect which induces heat, smoke, vapors and grease laden air into the hood for entrainment with the air streams. The exhaust plenum is equipped with an exhaust fan which draws air from the hood through inclined grease filters into the exhaust plenum and then out of the building through a suitable exhaust duct.

This construction provides an efficient exhaust system which operates by induction to draw heat and vapors from the oven into the hood where entrainment with the incoming air carries the heat and vapors out through the exhaust side of the system. The intake system creates this induction effect as a result of the forced flow of air at a high velocity through the slots, and the hood is arranged so that the air flow pattern is symmetrical and covers the entire area of the pizza oven, thus effectively exhausting the pizza oven while avoiding areas of turbulence and other flow disruptions. At the same time, the volume of the make up air that enters through the intake system is carefully controlled in order to avoid unduly adding to the load of the existing air handling equipment of the building.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
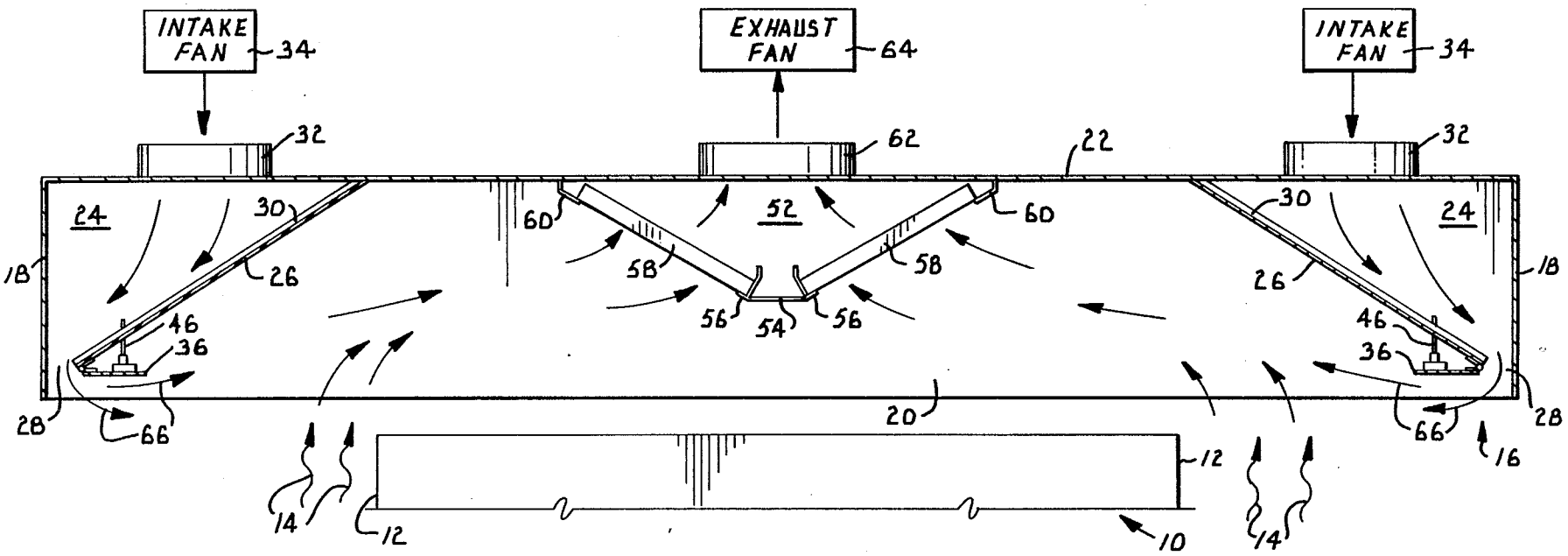
FIG. 1 is a sectional view taken on a vertical plane through a pizza oven exhaust hood constructed according to a preferred embodiment of the present invention.

Referring now to the drawings in more detail, numeral 10 designates a pizza oven which may be a conventional oven of the type used in the food industry to cook pizzas in restaurants, carry out facilities and other places where pizza is cooked. The oven 10 has opposite sides 12 from which heat, grease laden air, smoke, fumes, and vapors are discharged from the oven, as identified collectively by the arrows 14.

In accordance with the present invention, an overhead exhaust hood which is generally identified by numeral 16 is mounted above the pizza oven 10. The hood 16 is generally open at the bottom and includes opposite side panels 18, opposite end panels 20 and a top panel 22 which is connected to the side panels 18 and end panels 20. The side panels 18 are normally parallel to one another, as are the end panels 20. The top panel 22 is normally horizontal. The side panels 18 and/or the end panels 20 may be mounted in any suitable manner to the walls or other structure in the room which contains the pizza oven 10. As shown in FIG. 1, the side to side dimension of the hood 16 between the side panels 18 should be considerably greater than the side to side dimension of the pizza oven 10 between its opposite sides 12. The front to back dimension of the hood 16 between the end panels 20 is likewise preferably greater than the front to back dimension of the oven 10.

The hood 16 is provided with a pair of intake plenums 24 which extend along the opposite side panels 18 between the end panels 20. Each intake plenum 24 has a triangular configuration defined between the adjacent side panel 18, the adjacent part of the top panel 22, and an inclined plenum wall 26 which extends downwardly from the top panel 22. The inclined walls 26 on the two plenums 24 extend from panel 22 toward the adjacent side panels 18 in converging relationship thereto. A restricted throat 28 is formed at the bottom portion of each plenum 24 between the lower edge of wall 26 and panel 18. The throats 28 terminate near the bottom of the hood 16. A layer of insulation 30 is mounted on top of each inclined wall 26.

Each plenum 24 has an intake opening which extends through the top panel 22 and which is connected with an intake duct 32 having a complementary shape. An intake fan 34 which may be a conventional electrically powered fan draws in outside air and forces the air into the intake ducts 32 and through the intake opening into the top of each plenum 24. Each plenum 24 may receive air from the same intake fan, or each plenum may be equipped with its own intake fan if desired.

Figure 2:
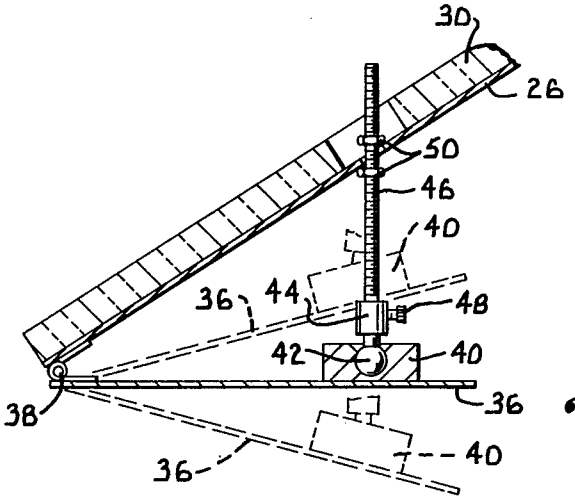
FIG. 2 is fragmentary sectional view, on an enlarged scale showing the baffle adjustment mechanism for one of the intake plenum of the exhaust hood shown in FIG. 1.

An adjustable baffle 36 is provided for each intake plenum 28 and extends along the entire length of the plenum. As best shown in FIG. 2, each baffle 36 is connected with the lower edge of the corresponding wall 26 by a piano type hinge 38 which permits the baffle to pivot about the hinge axis in order to adjust the air flow pattern. The baffle adjustment mechanism includes a block 40 which is mounted on top of baffle 36 and which has a spherical socket that receives a ball 42 carried on the lower end of a sleeve 44. A threaded rod 46 is threaded into the sleeve 44 and is locked thereto by a set screw 48. Rod 46 extends through panel 26 and receives nuts 50 located above and below panel 26. Each panel 26 has two of the baffle adjustment mechanisms, one located near each end of the plenum. By adjusting the nuts 50 upwardly on the rods 46, the baffle 36 can be pivoted downwardly. Conversely, when nuts 50 are adjusted downwardly on rods 46, baffle 36 is pulled upwardly about the axis of the hinge 38.

The hood 16 is provided with an exhaust plenum 52 which extends from front to back along the centerline of the hood or midway between the intake plenums 24. A bracket 54 extends between the end panels 20 and is suitably secured to them at the center of the hood 16. Projecting lips 56 on opposite sides of bracket 54 receive the lower edges of grease traps 58 through which air may flow into the exhaust plenum 52. The upper edges of the grease traps 58 are received on flanged brackets 60 which extend from the top panel 22 of the hood. The grease traps 58 are arranged to extend generally end to end along the length of each side of the plenum 52. The grease traps each incline outwardly from the bottom to top.

The grease traps 58 may be baffled grease traps which permit the flow of air through them and serve to remove grease from the air that passes through them. Preferably, the grease traps 58 may be easily removed, cleaned and replaced. Grease traps 58 are oriented on an incline which can vary in its angle of inclination depending upon the particular application of the hood.

An exhaust outlet extends through the top panel 22 above the exhaust plenum 52 and is connected with a suitable exhaust duct 62. An exhaust fan 64 which may be a conventional electrically powered exhaust fan is connected with the exhaust duct 62 in order to draw air through it and through the exhaust plenum 52.

In use of the hood 16, the intake fan 34 and the exhaust fan 64 are operated simultaneously, with the intake fan forcing fresh outside air into both intake plenums 24 and the exhaust fan operating to exhaust air from the hood through the exhaust plenum 52. The incoming air which enters the intake plenums 24 is forced through the restricted throats 28 toward the main portion of the exhaust hood 16. By adjusting the baffles 36 upwardly, the air which flows adjacent to the faces of the baffles follows a more upwardly directed path. Conversely, the air passing through the throats 28 can be directed more downwardly by adjusting the baffles downwardly.

In any event, the restricted throats 28 serve as slots which product high velocity air streams indicated by the directional arrows 66 which flow from the opposite sides 18 toward the central exhaust plenum 52 due to the low pressure created there by the exhaust fan 64. The high velocity air flow creates low pressure and an induction effect which induces the heat, grease laden air, fumes, smoke and vapors (14) to flow into the hood 16 where they are entrained by the air streams 66. The air streams thus carry the exhaust materials with them through the grease filters 58 and into the exhaust plenum 52 from which they are exhausted from the building through the exhaust ducts 62.

In this manner, the hood 16 sucks the exhaust materials 14 from the pizza oven 10 into the hood to efficiently exhaust them from the building. The hood has a symmetrical configuration which results in a symmetrical air flow pattern on opposite sides of the oven 10, thus assuring that substantially half of the incoming air flows originates on each side of the intake system. At the same time, the air flow is smooth at all locations within the hood 16 in order to avoid local disruptions such as local areas of turbulence which can detract from the efficiency of the exhaust system.

Uniform air distribution is provided along the length of the intake and exhaust plenums 24 and 52, and equal amounts of air flow through the two throats 28 along substantially their entire lengths. In addition, because of the inclined orientation of the grease traps 58, the exhaust materials 14 follow a smoothly curved path as they are drawn into the hood, and the absence of abrupt changes in the flow direction minimizes turbulence and other flow disruptions.

The intake and exhaust fans 34 and 64 are preferably balanced horsepower fans adjusted such that the intake fan 34 provides sufficient additional incoming air to make up for or nearly make up for the air that is exhausted from within the room by the exhaust side of the system. Consequently, the air handling equipment of the building is not subjected to a significantly added load as would be the case in the absence of fresh incoming air in the hood system.

The adjustable baffles 36 can be set at whatever angle results in the optimum flow pattern for each exhaust hood installation. By swinging the baffles 36 upwardly, more air and vapors are induced into the hood from the areas in the vicinity of the opposite sides of the oven 10. If there is a need for lesser exhaust volume, the baffles can be adjusted downwardly. In either case, areas of relatively low pressure are created above the opposite sides 12 of the oven to induce the flow of exhaust materials into the hood.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. In an exhaust system for a stationary pizza oven, the improvement comprising:

an overhead hood mounted above the oven, said hood having opposite sides extending along the hood from front to back and a top panel extending between said sides and from front to back;

a pair of inclined walls angling at an inclined orientation from the top panel of the hood toward the respective opposite sides thereof to provide a pair of air intake plenums extending along said sides and along said top panel, each inclined wall terminating in an edge spaced from the corresponding side of the hood to define an elongate outlet slot for discharging air from the corresponding intake plenum;

an exhaust plenum located substantially midway between said said intake plenums and extending along said top panel from front to back;

an exhaust duct connecting with said exhaust plenum through said top panel;

exhaust fan means for drawing air from the hood into said exhaust plenum and out through said exhaust duct in a manner to subject the entirety of the exhaust plenum to substantially equal pressure;

an intake duct for each intake plenum connecting therewith through said top panel;

filter means for filtering grease from the air which enters said exhaust plenum; and intake fan means located outside of said intake plenums for forcing outside air into each of said intake ducts in a manner to subject the entirety of intake plenums to substantially equal pressure for discharge of incoming air therefrom through said outlet slots in a pair of high velocity air streams flowing in the hood in opposite directions toward said exhaust plenum to draw heat and vapor from the oven into said air streams by induction for passage therewith through said filter means.

2. The improvement of claim 1, wherein each intake plenum has a generally triangular shape.

3. The improvement of claim 1, including:

a baffle for each intake plenum located adjacent the outlet slot thereof for directing the air passing through the slot; and means for adjusting the position of each baffle to vary the path followed by the air passing through the slot.

* * * * *